United States Patent [19]

Sawada

[11] Patent Number: 4,654,487

[45] Date of Patent: Mar. 31, 1987

[54] SWITCH CONTROL UNIT FOR OPERATING POWER WINDOWS OF AN AUTOMOBILE

[75] Inventor: Kenji Sawada, Furukawa, Japan

[73] Assignee: Alps Electric Co., Ltd., Japan

[21] Appl. No.: 795,119

[22] Filed: Nov. 5, 1985

[30] Foreign Application Priority Data

Nov. 5, 1984 [JP] Japan ..... 59-167543[U]

[51] Int. Cl.[4] ..... H01H 9/00

[52] U.S. Cl. ..... 200/1 V; 200/5 R

[58] Field of Search ..... 200/5 R, 5 B, 5 C, 5 D, 200/5 E, 6 B, 6 BA, 6 BB, 52 R, 61.54, 1 V

[56] References Cited

U.S. PATENT DOCUMENTS

| | | | |
|---|---|---|---|
| 2,966,559 | 12/1960 | Meyer | 200/6 BB |
| 2,972,663 | 2/1961 | Zanichkowsky et al. | 200/6 BA |
| 3,222,467 | 12/1965 | Meyer | 200/6 BB X |
| 3,836,736 | 9/1974 | Golbeck | 200/5 C X |
| 4,180,713 | 12/1979 | Gonzales | 200/52 R |

*Primary Examiner*—J. R. Scott

*Attorney, Agent, or Firm*—Guy W. Shoup

[57] ABSTRACT

A switch block for automotive power windows has four seesaw switches and a push-button switch for breaking an electric circuit to simultaneously lock out the seesaw switches. The contact mechanisms of the seesaw switches and of the push-button switch are identical in structure so that they have an identical operating feel.

3 Claims, 7 Drawing Figures

SWITCH CONTROL UNIT FOR OPERATING POWER WINDOWS OF AN AUTOMOBILE

FIELD OF THE INVENTION

The present invention relates to a switch block and, more particularly, to a switch block that can be conveniently used as a switch block for automotive power windows.

BACKGROUND OF THE INVENTION

Heretofore, switch blocks of this kind have tended to be complex in structure and large in size. They incorporated seesaw switches for opening and closing windowpanes and a separate push-button switch for electrically locking out these seesaw switches. The switches used different mechanisms for driving their respective movable contacts and consequently, the operator felt an unnatural difference, depending on which of these two kinds of switches was being operated.

SUMMARY OF THE INVENTION

It is the object of the present invention to provide a switch block which is free of the foregoing problems with the prior art switch block, can be manufactured small in size and in small thickness, has a simple structure, gives the same feeling to the operator whether he operates a seesaw switch or a push-button switch, and permits the operator to easily control the direction of the automobile windows which are moved by respective motors.

The above object is achieved in accordance with the teachings of the invention by a switch block having seesaw switches for selectively rotating a motor in forward and reverse directions, a push-button switch for simultaneously locking out the seesaw switches, where almost identical mechanisms are used for driving the movable contacts of the seesaw switches and of the push-button switch, each of the driving mechanisms having a movable contact member pivotally held by a supporting terminal and operated to move from a first position to a second position by a resilient driving element.

DETAILED DESCRIPTION OF THE INVENTION

Figure 1:
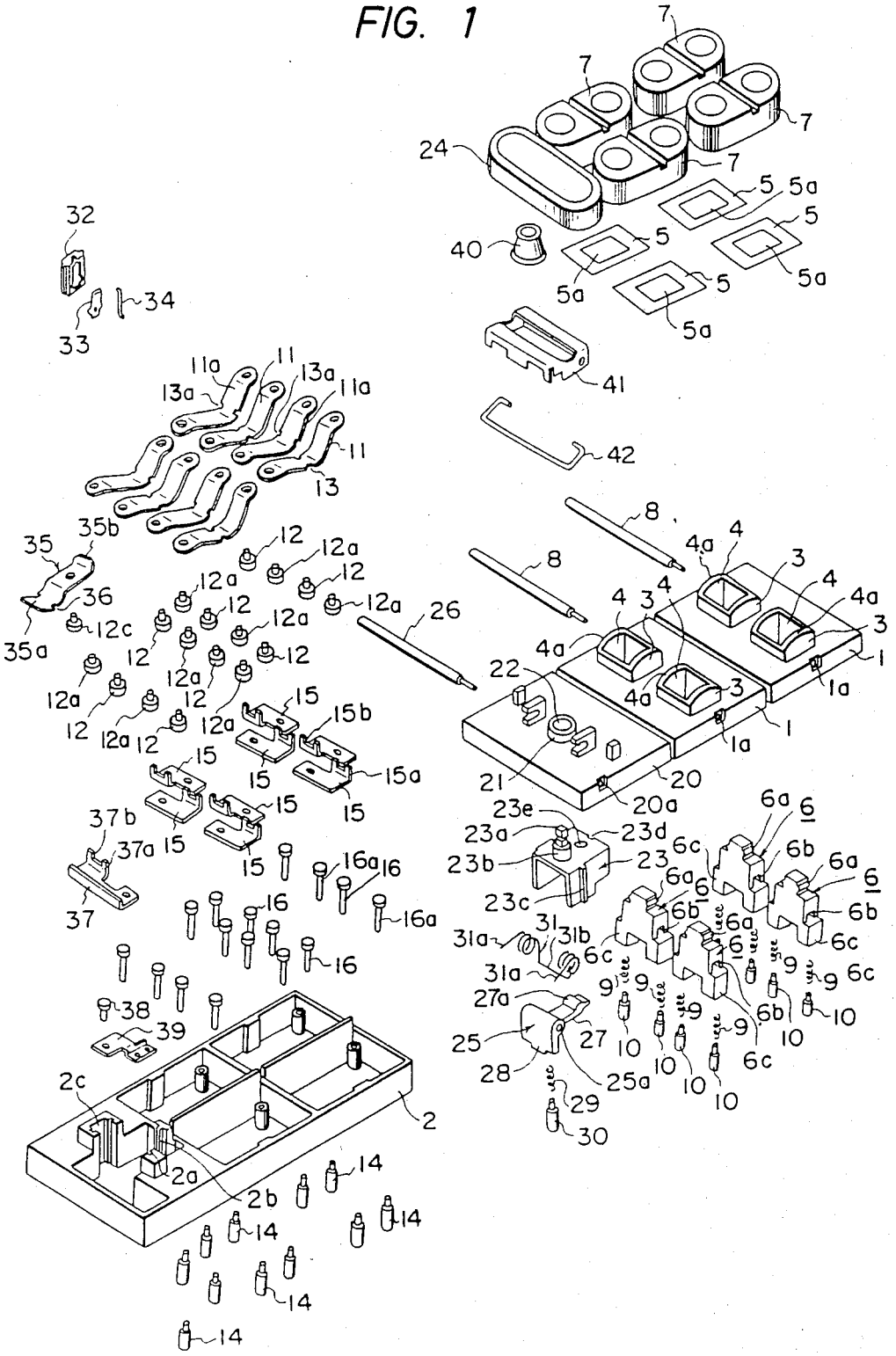
FIG. 1 is an exploded perspective view of a switch block which is manufactured in accordance with the invention for use with automotive power windows.

FIG. 1 is an exploded perspective view of a switch block for automotive power windows, the switch block having been manufactured in accordance with the invention. This block has seesaw switches for opening and closing windowpanes. The seesaw switches are four in usual number to conform to the number of the windowpanes in an automobile. Each seesaw switch has two movable contact members 11 and 11*a* with notches 13 and 13*a* for opposing rotation on their respective support portions 15*b*. These are described later.

The switch block has upper cases 1 which engage a lower case 2 to form a switch casing. The upper surfaces of the upper cases 1 have openings 4 which are surrounded by semicylindrical upright walls 3. Grease or similar material having viscosity is applied to the fringe surfaces 4*a* of the openings 4. A resilient waterproof sheet 5 made of a synthetic resin is placed on each fringe 4*a*. The waterproof sheet 5 is centrally provided with a hole 5*a* through which part of an operating member 7 projects to mate with a lever 6. The projecting part of the operation member makes intimate contact with the edge of the hole 5*a* through which it passes. The head of the lever 7 mates to the operation member with a press fit. The operation member has a semicylindrical bottom which matches that of the fringe surface 4*a* below it with the sheet 5 providing a waterproof seal in between. Therefore, as the operation member is pivoted, the sheet 5 sealingly slide on the fringe 4*a* with excellent tightness.

The head of each lever 6 passes through each opening 4. The head of the lever 6 has a protruding portion 6*a*. Operation members 7 are mounted over their corresponding protruding portions 6*a* of the levers 6 with a press fit. Each lever 6 is centrally provided with a hole 6*b* extending laterally through the lever. A pivot 8 passes through the hole 6*b*. Each upper case 1 has a retaining hole 1*a* through which one end of the pivot 8 passes. This end is caulked so as to be held to the upper case 1. Thus, the lever 6 is rotatably held to the upper case 1 by the pivot 8. Each lever 6 is provided with a pair of driving element-receiving portions 6*c* at its lower end. The receiving portions 6*c* are biased downward by coiled springs 9. Driving elements 10 whose front ends are spherical are received in the receiving portions 6*c* in such a way that their front ends protrude.

Movable contact members 11 and 11*a* are rotated by the driving elements 10. Each of these contact members 11 and 11*a* is bent into a V-shaped form. Movable contacts 12 and 12*a* are firmly fixed to both ends of each of the movable contact members 11 and 11*a*. Notches 13 and 13*a* are formed in each of the movable contact members 11 and 11*a* at positions which are at some distance from the central bent base portion in opposite relation. Common terminals 15 are fixed to the lower case 2 with terminals 14 by caulking. Each common terminal 15 has an upright wall 15*a* whose top fringe is cut out to form a support portion 15*b*. These support portions 15*b* are received in the notches 13 and 13*a*. Each of the movable contact members 11 and 11*a* is rotated about its respective support portion 15*b*.

Fixed terminals 16 and 16*a* are secured to the lower case 2. Of these terminals 16 and 16*a*, the terminals 16*a* which are normally conducting electrical current are made of a cheap contact material and plated with an expensive contact material such as gold or silver. Similarly, the movable contacts 12*a* are made of a cheap material and plated with silver. On the other hand, normally open contacts 12 and 16 are made using more of the expensive material such as gold or silver to prevent oxidation. Thus, by reducing the expensive material in the normally closed contacts, these components are economical to manufacture and their raw prices are unaffected by variations in the market price.

Figure 2:
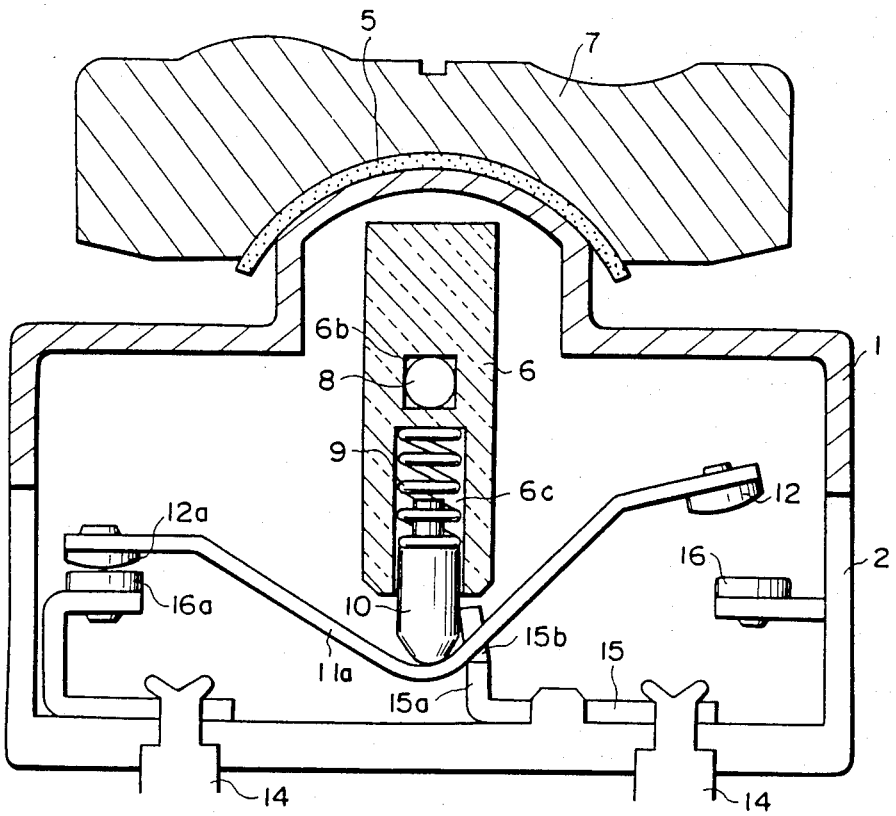
FIG. 2 is a cross-sectional view of one-half of a seesaw switch of the switch block shown in FIG. 1.
Figure 3:
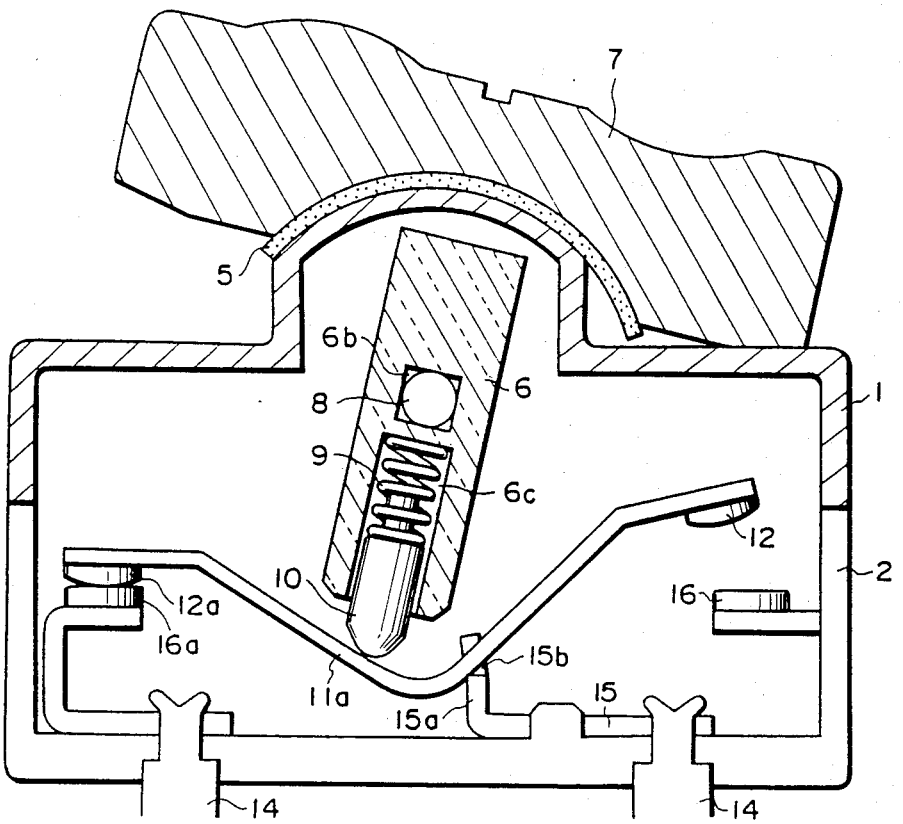
FIG. 3 is a view similar to FIG. 2, but in which the seesaw switch is in operation.
Figure 4:
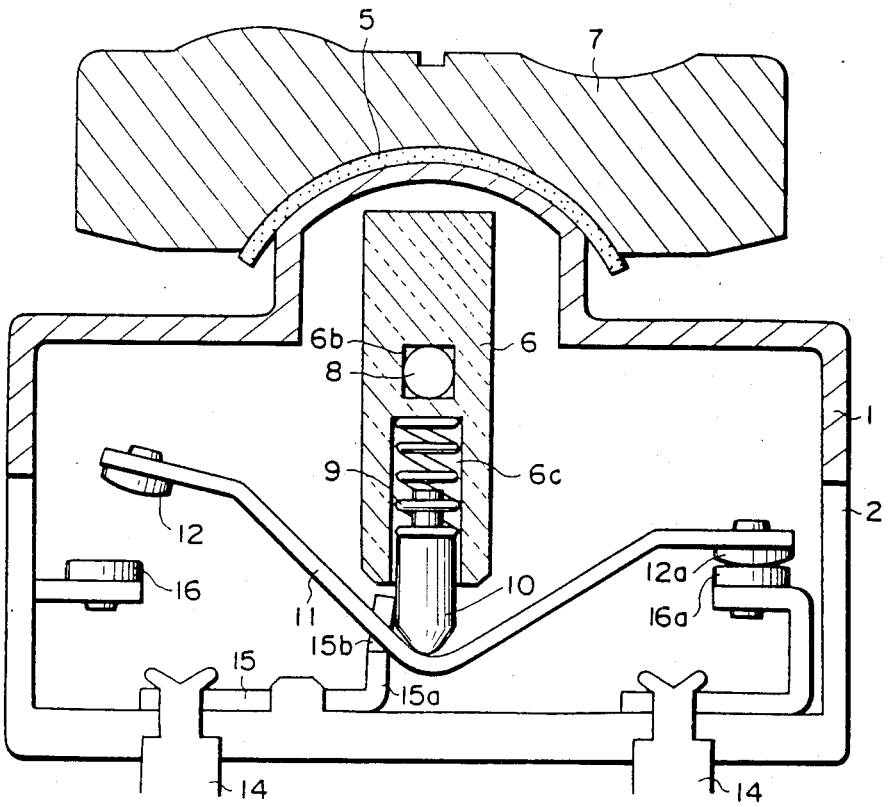
FIG. 4 is a cross-sectional view of the other half of a seesaw switch of the switch block shown in FIG. 1.

FIGS. 2 and 3 show contact member 11*a* which pivots clockwise about support 15*b* when driven by the driving element 10. FIGS. 3 and 4 show contact member 11 which can pivot the other way about its support member 15*b*. Each single switch incorporates two contact members, 11 and 11*a* for rotating a motor in opposite directions to elevate and lower a windowpane. More specifically, when the operation member 7 is tilted, the lever 6 is rotated. This causes the driving element 10 to make sliding contact with the upper surface of the movable contact members 11 and 11*a*, rotating ones of the opposing contact members 11 or 11*a*. When the driving elements 10 are not operated, they rest at the center of the movable contact member 11 and 11*a*. Under this condition, the motor circuit is not supplied with electrical current, and the motor is grounded to stop its operation.

Figure 5:
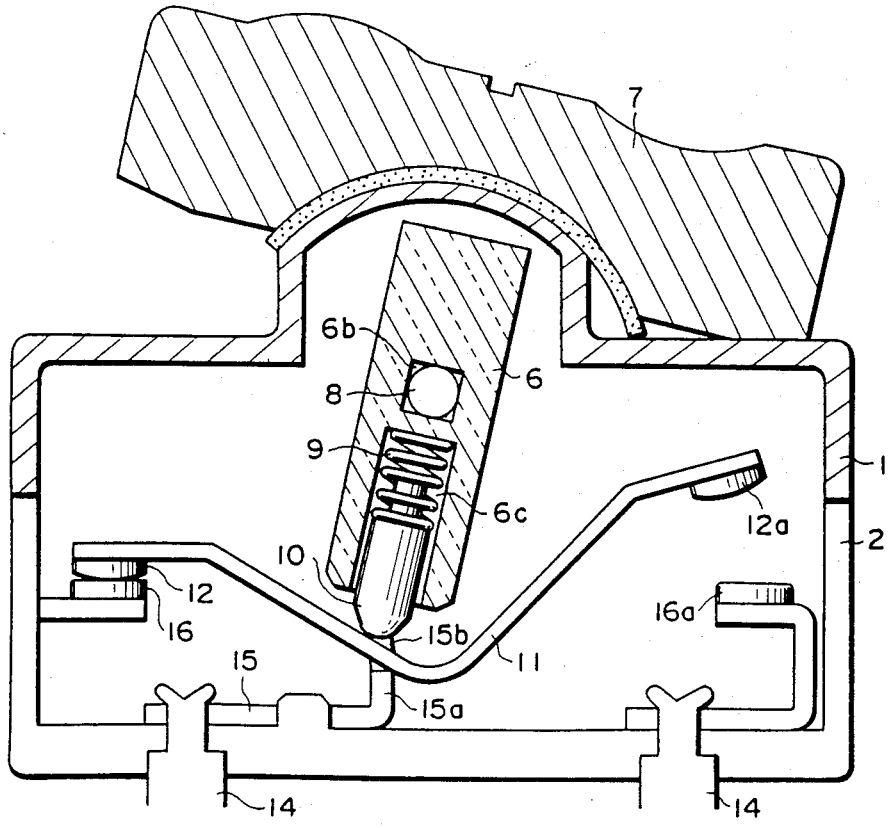
FIG. 5 is a view similar to FIG. 4, but in which the seesaw switch is in operation.
Figure 6:
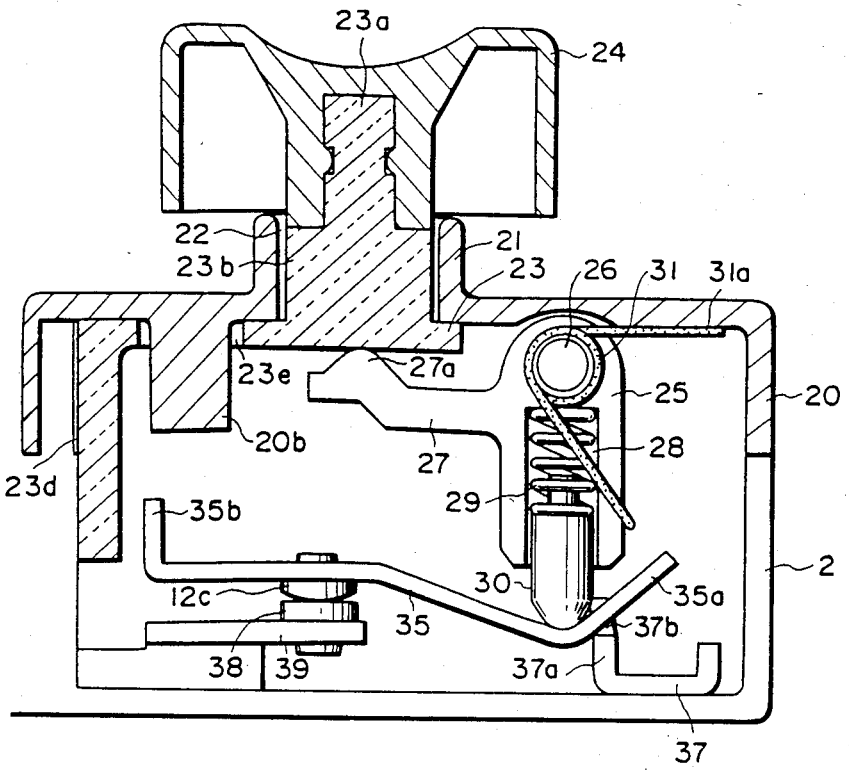
FIG. 6 is a cross-sectional view of the push-button switch of the switch block shown in FIG. 1.
Figure 7:
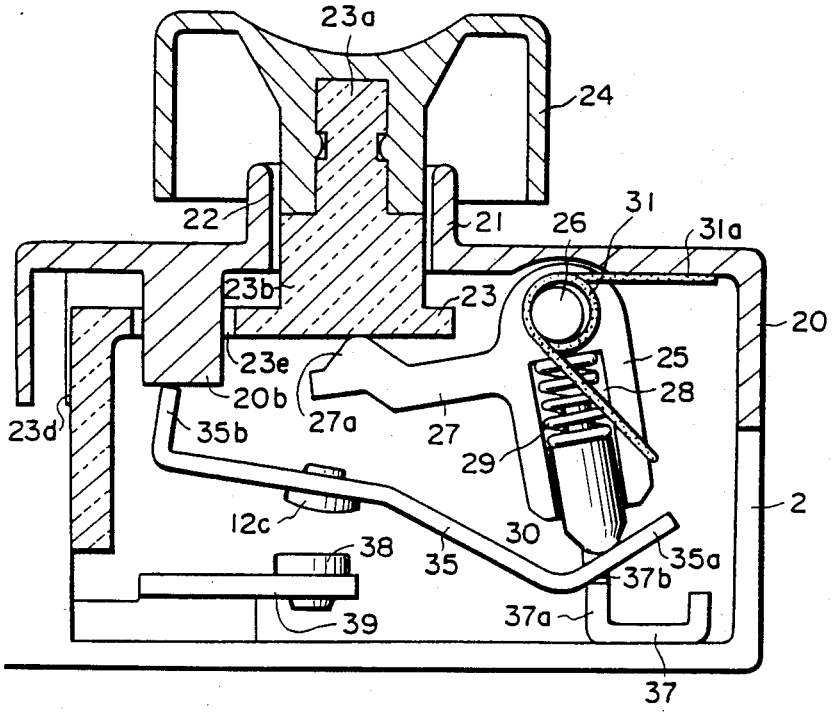
FIG. 7 is a view similar to FIG. 6, but in which the push-button switch is in operation.

When the driving element 10 is shifted to the left, for example, when the operation member 7 is tilted to the right, as shown in FIG. 5, one circuit for rotating the motor in forward or reverse direction is set into operation, while the other circuit is rendered inoperative in spite of the movement of the driving element 10. Although not shown, when the driving element 10 is moved to the right, the configuration operates in exactly opposite relation to the foregoing.

Since each of the movable contact member 11 and 11*a* is bent into a V-shaped form having opposing inclines, when the movable contacts 12 and 12*a* bear against fixed terminals 16 and 16*a*, respectively, the relation of the inclines to the driving element 10 produces a restoring force, returning the switch to its normal resting position.

A push-button switch is used to simultaneously lock the aforementioned seesaw switches for safety purposes. An upper case 20 engages with the lower case 2 to form the casing of the push-button switch. An opening 22 that is surrounded by an annular upright wall 21 is formed substantially in the center of the upper case 20. A slider 23 has a rectangular head 23*a* and a cylindrical portion 23*b*. An insert 24 is mounted over the rectangular head 23*a* of the slider 23 with a press fit. The cylindrical portion 23*b* is fitted in the opening 22 so that the slider 23 is slidable. The slider 23 is shaped like a box and opens on one side. The wall surface of the slider 23 is provided with a protrusion 23*c* and a groove 23*d* which engage a guide groove 2*a* and a guide rail 2*b*, respectively, formed in and on the lower case 2 to guide the slider 23 when it slides. Another surface has a heart-shaped cam (not shown). The top surface is provided with a hole 23*e* extending through it. A protruding portion (described later) formed on the upper case 20 passes through the hole 23*e*.

A lever 25 is provided with a hole 25*a* extending through it. A pivot 26 has one thin end which is inserted into a retaining hole 20*a* formed in the upper case 20 and retained by caulking. The pivot 26 passes through the hole 25*a*. Thus, the lever 25 is rotatably held to the upper case 20. An arm 27 which is inserted through the open side of the slider 23 is integral with the lever 25. A protruding portion 27*a* that bears against the bottom of the slider 23 is formed on the upper surface of the front end portion of the arm 27.

The lever 25 is provided with a hole 28 to receive a driving element 30 such that its spherical front end protrudes. The driving element 30 is biased downward by a coiled spring 29.

A restoring spring 31 is wound on the pivot 26 and has its both ends 31*a* held against the upper surface of the upper case 20. The spring 31 has a straight portion 31*b* bearing against the wall surface that lies in the direction of rotation of the lever 25.

A guide plate 32 is fitted in a recess 2*c* formed in the lower case 2. A single-acting pin 34 is mounted on the front surface of the guide plate 32 via a single-acting pin 33. The pin 34 engages and disengages from the aforementioned heart-shaped cam of the slider 23 to lock and unlock the switch.

A movable contact member 35 is rotated by the driving element 30, and has a bent portion 35*a* at its one end. Formed at the other end of the contact member 35 is a stopping protrusion 35*B* which bears against a protruding portion 20*b* formed on the upper case 20 to stop rotation of the contact member 35. The slider 23 is provided with a hole 23*e* extending through it. The protruding portion 20*b* extends through the hole 23*e*. The base of the bent portion 35*a* of the contact member 35 has a notch 36. A support portion 37*b* which is formed by cutting out the top fringe of the upright wall 37*a* of a common terminal 37 engages the notch 36. The terminal 37 is fixed to the lower case 2 with a terminal 14. The movable contact member 35 is rotated about the support portion 37*b*. A movable contact 12*c* is firmly fixed to the movable contact member 35. A fixed terminal 39 which is affixed to the lower case 2 with terminals 14 has a fixed contact 38. A waterproof cap 40 made of a resilient material, such as rubber, is put on the upright wall 21 of the upper case 20. A fixing plate 41 prevents the insert 24 from swinging. A link 42 is attached to the fixing plate 41.

In the operation of the push-button switch constructed as described above, when the insert 24 is depressed, the bottom of the slider 23 is pressed against the protruding portion 27*a* of the arm 27 integral with the lever 25. This force is transmitted as a rotary force to the lever 25 via the arm 27. Thus, the lever 25 is rotated, so that the driving element 30 makes sliding contact with the bent portion 35*a* of the movable contact member 35 and moves upward along it to thereby rotate the the contact member 35. At this time, the rotation of the contact member 35 stops by the abutment of the stopping protrusion 35*b* of the contact member 35 against the protruding portion 20*b* of the upper case 20. Hence, the gap between the movable contact 12*c* and the fixed contact 38 is made predictable and stable. With the movable contact 12*c* and the fixed contact 38 separated, an electric circuit to the motor for operating the windows is disconnected, and the seesaw switches 7 are prevented from operating any of the windows as a safety precaution. Since the driving element 30 moves up along the incline of the bent portion 35*a* of the contact member 35, the compression of the coiled spring 29 biasing the driving element 30 produces a restoring force. This force is combined with the restoring force produced by the spring 31 to create a large total restoring force, thus preventing incomplete return of the contact member.

As described thus far, in the novel switch block, a mechanism for switching normally open and normally closed contacts with one action is incorporated in one seesaw switch, whereby a switch is provided which can easily control a motor to obtain forward, reverse or stopped rotation. The mechanism for driving the movable contact member of the push-button switch is made identical with the structure of the seesaw switch. This contributes to miniaturization and smaller thickness of the product. Consequently, a simple switch block can be had whose switches can be operated with the same, and accordingly natural, feeling.

What is claimed is:

1. A plural switch control unit comprising:

a plurality of seesaw switches, each including an operation member rockable in two directions, a lever pivotable by said operation member to move a lower end thereof oppositely in either direction, said lower end of said lever having a pair of driving elements which are spaced apart from each other and are each mounted in said lower end with a spring so as to be biased downwardly, and a pair of V-shaped movable contact members each disposed below and in sliding contact with a respective one of said driving elements, said movable contact members each having a movable contact on an end thereof opposite from the other movable contact member which is movable into contact with a respective fixed contact in said switch control unit as said movable contact members are pivoted together upon moving said driving elements along said movable contact members in one direction or the other by rocking said operation member, each said movable contact operating a respective one of two circuits for driving an associated motor in forward and reverse directions, respectively; and a normally closed pushbutton switch including an operation member depressable downwardly, a lever having one end movable by said operation member so as to pivot the other end thereof, said lever having a driving element mounted in said other end with a spring so as to be biased downwardly, and a V-shaped movable contact member disposed below and in sliding contact with said driving element, said movable contact member having a movable contact on an end thereof which is movable into contact with a fixed contact in said switch control unit as said movable contact member is pivoted upon moving said driving element along said movable contact member by depressing said operation member, said movable contact opening a main circuit for locking out the driving circuits of said plurality of seesaw switches simultaneously, wherein said springs, driving elements, and movable contact members of said seesaw switches and said spring, driving element, and movable contact member of said pushbutton switch are all of a similar construction such that the operational feeling of all of said switches is similar.

2. A switch block as set forth in claim 1, wherein each of the seesaw switches is used to open or close a window.

3. A switch block as set forth in claim 1, wherein each movable contact member has movable contacts at both ends thereof.

* * * * *